US005603295A

United States Patent [19]

Töpfer et al.

[11] Patent Number: 5,603,295

[45] Date of Patent: Feb. 18, 1997

[54] INTERNAL-COMBUSTION ENGINE COMPRISING AN INTAKE SYSTEM

[75] Inventors: Walter Töpfer, Iptingen; Franz Eberle, Stuttgart; Dietmar Krüger, Friolzheim; Norbert Kleinehakenkamp, Weissach, all of Germany; Michail I. Fesina, Togliatti, Russian Federation; Rudolf N. Starobinskij, Togliatti, Russian Federation; Jurij P. Lasarev, Togliatti, Russian Federation; Evgenij V. Lysenko, Togliatti, Russian Federation

[73] Assignee: Ing. h.c.F. Porsche AG, Weissach, Germany

[21] Appl. No.: 387,872

[22] PCT Filed: Aug. 22, 1992

[86] PCT No.: PCT/EP92/01929

§ 371 Date: Jul. 6, 1995

§ 102(e) Date: Jul. 6, 1995

[87] PCT Pub. No.: WO94/04815

PCT Pub. Date: Mar. 3, 1994

[51] Int. Cl.[6] ..... F02M 35/10

[52] U.S. Cl. ..... 123/184.42; 123/184.47

[58] Field of Search ..... 123/184.38, 184.42, 123/184.47, 184.53

[56] References Cited

U.S. PATENT DOCUMENTS

| | | | |
|---|---|---|---|
| 1,818,283 | 8/1931 | Spencer | 123/184.38 |
| 2,740,389 | 4/1956 | Reyl | 123/184.42 |
| 4,064,696 | 12/1977 | Cser | 123/184.42 |
| 4,543,918 | 10/1985 | Ma | 123/184.42 |
| 4,640,256 | 2/1987 | Conrad et al. | 123/184.38 |
| 5,537,965 | 7/1996 | Topfer et al. | 123/184.42 |

FOREIGN PATENT DOCUMENTS

| | | | |
|---|---|---|---|
| 0351520 | 5/1989 | European Pat. Off. . | |
| 510261 | 10/1930 | Germany . | |
| 1238718 | 4/1967 | Germany | 123/184.38 |
| 2527774 | 12/1976 | Germany . | |
| 3742057 | 9/1988 | Germany . | |
| 968494 | 10/1982 | U.S.S.R. . | |
| 2228046 | 8/1990 | United Kingdom . | |

*Primary Examiner*—David A. Okonsky

*Attorney, Agent, or Firm*—Evenson McKeown Edwards Lenahan, PLLC

[57] ABSTRACT

An internal-combustion engine having an intake system comprises a chamber having an intake connection and individual suction pipes which are connected with a cylinder head and which lead into the individual cylinders. The interior of the chamber is connected to a pollutant reducing system which comprises at least one of the systems, such as a housing venting system, an auxiliary-air feeding system, a fuel vapor catch system and an exhaust gas return system. An intake pipe, which projects into the chamber of the intake system, which has a mouth opening approximately in a plane between two central individual suction pipes, is fastened to the intake connection, and a pipe connection, which connects the systems of the pollutant reducing system, leads into the interior of the chamber.

12 Claims, 4 Drawing Sheets

INTERNAL-COMBUSTION ENGINE COMPRISING AN INTAKE SYSTEM

BACKGROUND AND SUMMARY OF THE INVENTION

The invention relates to an internal-combustion engine comprising an intake system consisting of a chamber having an intake connection and individual suction pipes which are connected with a cylinder head and which lead into the individual cylinders, the interior of the chamber being connected to a pollutant reducing system which comprises at least one of the systems, such as a housing venting system, an auxiliary-air feeding system, a fuel vapor catch system and an exhaust gas return system.

Because of a variable air flow rate to the individual cylinders, airborne noises occur in an intake system of an internal-combustion engine which may radiate toward the outside. Furthermore, a back and forth movement of the pistons in the cylinders of the internal-combustion engine is accompanied by a volume change of the air supply to the individual engine cylinders and the exhaust system. In this case, the gases move in the above-mentioned pipes with pressure fluctuations whose magnitude and direction is determined by the engine operation. These pressure fluctuations of the gases are the cause of gas-dynamic and acoustic phenomena which under certain conditions may have a negative influence on the engine operation. In particular, the volumes of the pipes determine the sound radiation which is generated by the parts which connect the gas pipes with the outside air, such as the inlet opening of the air intake of the air purifier or the outlet opening of the exhaust pipes. The same reasons cause a discontinuity of the gas flows in the pipes of the pollutant reducing system which may considerably impair its function.

It is an object of the invention to provide an intake system for an internal-combustion engine which, in addition to reducing airborne noises, also causes a decrease of the emission of pollutants.

According to the invention, this object is achieved by means of an arrangement wherein an intake pipe, which projects into the chamber of the intake system, is fastened to the intake connection, which intake pipe has a mouth opening approximately in a plane between two central individual suction pipes and, and a pipe connection leads into the interior of the chamber which connects the systems to of the pollutant reducing system.

By means of the arrangement of an intake pipe which projects into the chamber interior of the intake system and which is connected with the intake connection of the chamber, a noise reduction is essentially achieved, in which case a significant reduction of the emission of pollutants is achieved as a result of this pipe, in connection with a connection piece which branches off a pollutant reducing system and which also leads into the interior of the chamber or of the pipe.

For this purpose, the mouth opening of the connection piece is arranged at a defined distance from the center of gravity of the interior volume of the chamber of the intake system.

Advantageously, the connection piece may also have an oblique mouth opening which causes an increased mixing of the flows from the pollutant reducing system and from the intake connection.

A contraction of the pipe in the manner of a diffuser in the area of the entering of the pipe connection into the intake pipe causes, in the area of the contraction, an increase of the flow velocity of the gas flow from the intake connection, whereby an additional gas flow from the pollutant reducing system is generated and a mixing effect is caused.

Other objects, advantages and novel features of the present invention will become apparent from the following detailed description of the invention when considered in conjunction with the accompanying drawings.

DETAILED DESCRIPTION OF THE DRAWINGS

Figure 1:
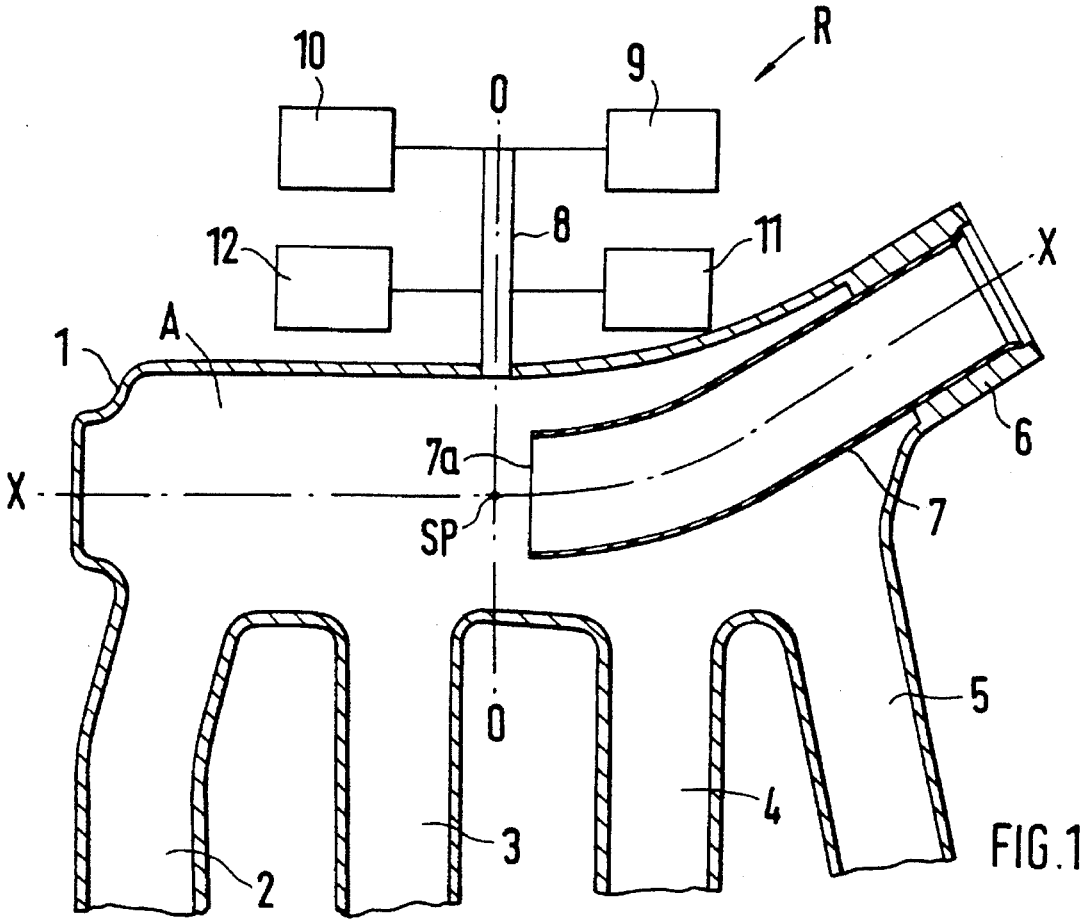
FIG. 1 is a sectional view of a chamber of an intake system with an inserted intake pipe and an assigned pollutant reducing system with a connected connection piece.

The internal-combustion engine comprises an intake system having a chamber 1 whose interior A is connected to a cylinder head by way of individual suction pipes 2, 3, 4 and 5. An intake connection 6 of the chamber 1 is connected with an intake pipe 7 for the air supply which projects into it and which is connected to an air supply system. A pollutant reducing system R, which comprises at least one exhaust gas return device 9, a housing venting system 10, an auxiliary-air feeding system 11 and a fuel vapor catch system 12, is connected with the interior A of the chamber 1 by way of a pipe connection 8.

Figure 2:
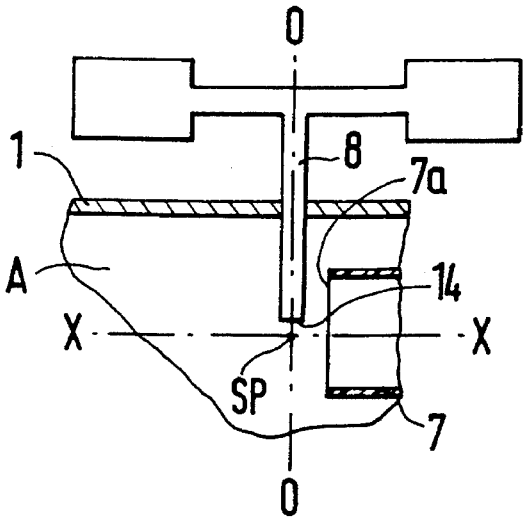
FIG. 2 is a view of the construction of the chamber with a defined position of the connection piece.
Figure 3:
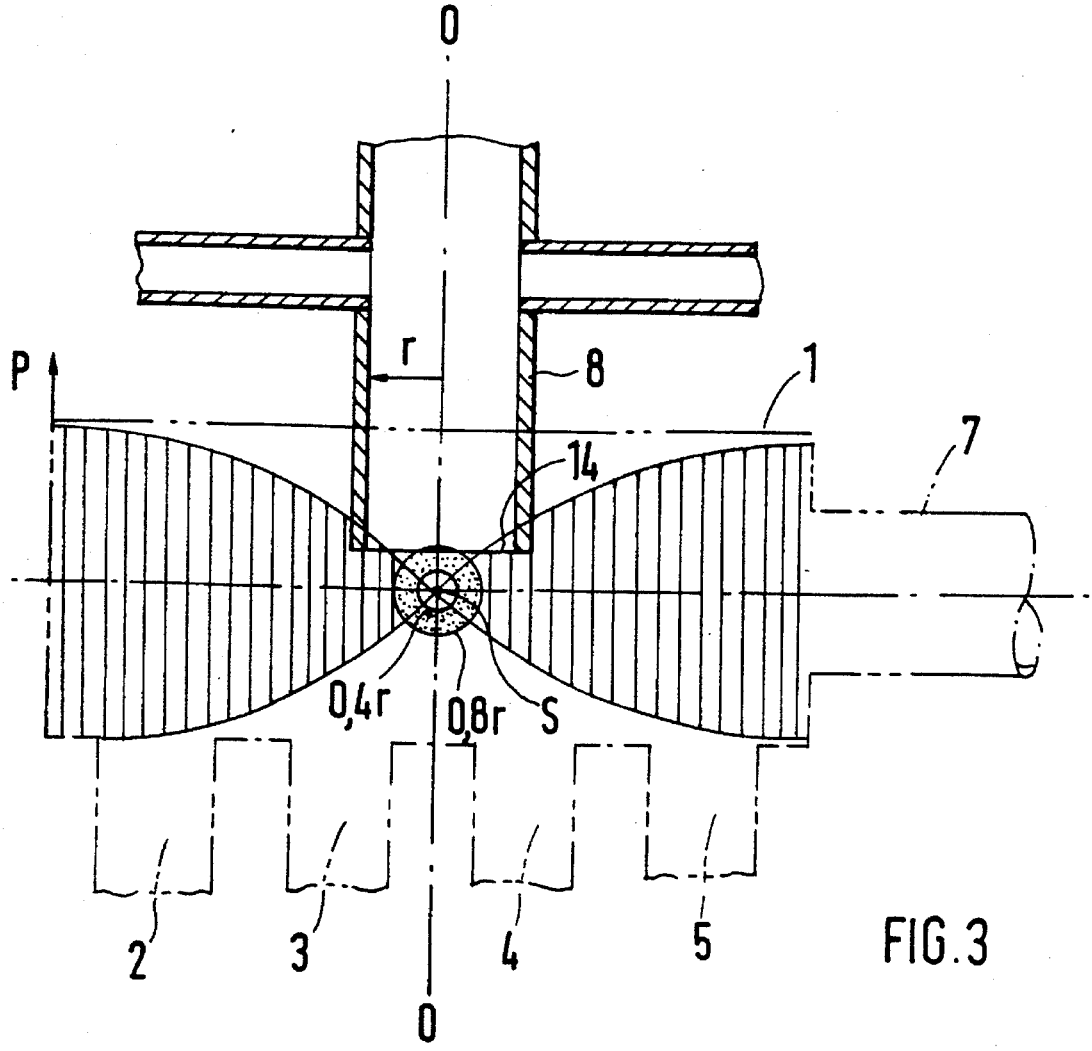
FIG. 3 is a representation of the sound pressure in the chamber interior at the lowest energy vibration form of the air volume.
Figure 4:
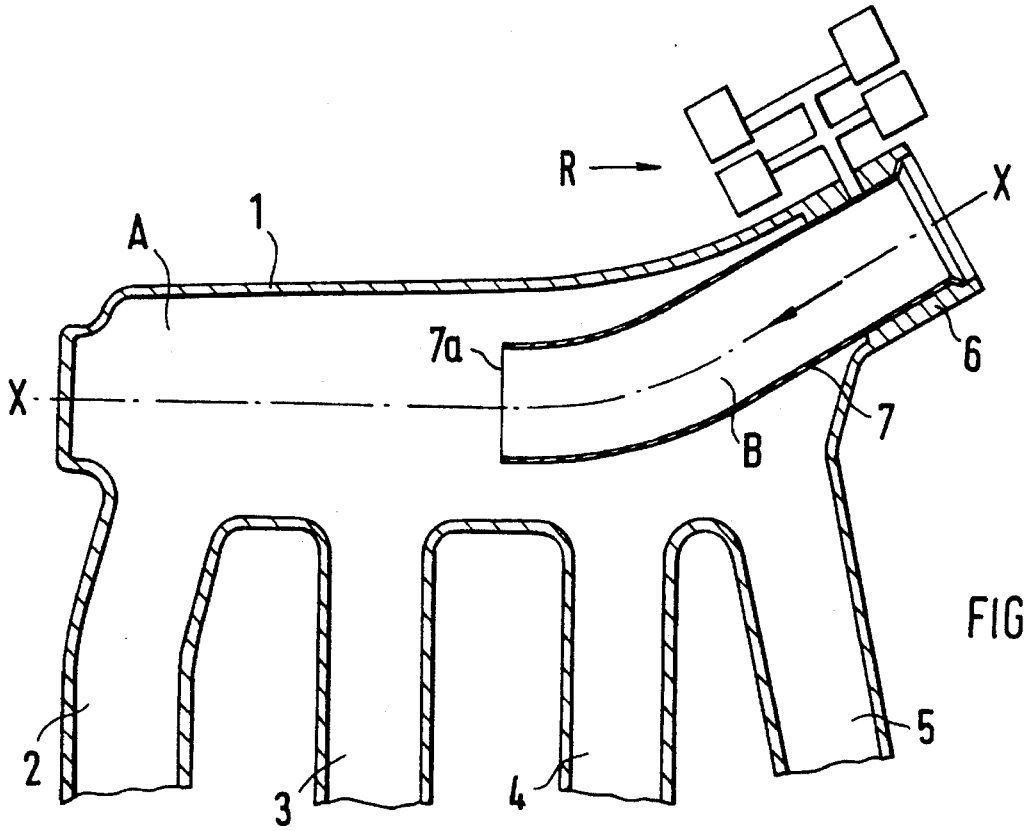
FIG. 4 is a sectional representation of the chamber of the intake system with the connected pollutant reducing system.

In FIGS. 2 and 3, the pipe connection 8 is shown in detail which branches off the pollutant reducing system R and is situated in front of the free end of the pipe 7 with its mouth opening 14 in a plane 0—0 of the chamber cross-section which extends approximately through the center of gravity SP of the interior volume of the chamber 1. The pipe connection 8 has a radius r and is connected with at least one or several of the systems 9, 10, 11 or 12.

During the operation of the engine, the following operating process occurs in the space of the chamber: The gas volume in the interior space A of the chamber 1 may be considered to be a mass which is distributed in the volume and which has its own characteristic elastic values. This mass is excited by means of the individual suction pipes 2 to 5, which are connected with the individual engine cylinders, as well as by the pipe connection 8 of the pollutant reducing system R. As a result of this excitation, the gas volume in the interior A starts to carry out vibrations in the natural frequency range. The most intensive vibrations are the vibrations of the gas volume in the interior A in the lowest natural resonance form, as indicated in detail in FIG. 3, which are distinguished by a considerable bundling (and with P max) as well as by a node, wherein P=0. As a result, on the one hand, the pulsation intensity of the pressures is increased in the pipes of the pollutant reducing system R and, on the other hand, the sound radiation to the environment increases because of the components which connect the gas pipes of the engine to the outside.

By means of the arrangement according to the invention, the effect of the gas volume vibrations in space A in the most energy-intensive natural resonance forms on the acoustic and gas-dynamic processes is to be either excluded or at least significantly reduced in order to improve the pollutant-related characteristics of the engine.

For this purpose, within the engine, the mouth opening 14 of the pipe connection 8 of the pollutant reducing system R is connected to the interior A of the-chamber 1 in the plane 0—0 which coincides with the plane of the cross-section of the chamber 1 and extends through the center of gravity SP of the volume of the space A of the chamber 1. As illustrated in detail in FIG. 3, this position of the opening 14 corresponds to its arrangement in the plane in which the pressure P is theoretically=0 and is virtually close to this value. Thus, the effect of this most energy-intensive form of the vibrations in space A on the gas-dynamic processes which occur during the engine operation in the connections of the pollutant reducing system R, becomes minimal so that the flows in the pipes of the systems 9 to 12 become steady or approach this physical condition. As a result, the efficiency of these systems 9 to 12 is finally increased and the pollutants of the engine are reduced.

At the same time, as a result of the above, the acoustic energy of the vibration form to be considered (and of all other analogous non-linear vibration forms) is not transmitted from the interior A by way of the mouth opening 14 and farther into the environment which leads to the improvement of the acoustic engine characteristics.

The effectiveness is increased when the dynamic flow course in front of the mouth opening 14 of the pipe connection 8 is placed together with the center of gravity SP of the space volume of the chamber 1. By means of this flow course, the influence of the dynamic process taking place in the pipe connection 8 can be taken into account in a defined manner. The center of gravity of the plane of the output velocities of the gas flow pulsating in the pipe connection 8, in an open space, is preferably at a distance 0.6 r in front of the mouth opening of the connection piece 8. The distance may effectively be in a range of from 0.4 to 0.8 r, which is connected with a range of construction factors, process-technological factors and other factors. Thus, the position of the dynamic flow course in front of the connection piece 8 in the space whose center coincides with the center of gravity SP, whose radius, however, =0.4 r and 0.8 r, excludes the excitation of the gas volume in the space A in the connection piece 8 with the lowest natural transverse vibration form (starting at FIG. 3); i.e., of the most energy-intensive form, which correspondingly increases the characteristic acoustic values of the engine.

According to the other embodiments of the invention according to FIGS. 4 to 7, the pipe connection 8 leads by means of its outlet opening 14 into the interior B of the intake connection 6 of the pipe 7 for the air supply.

Figure 5:
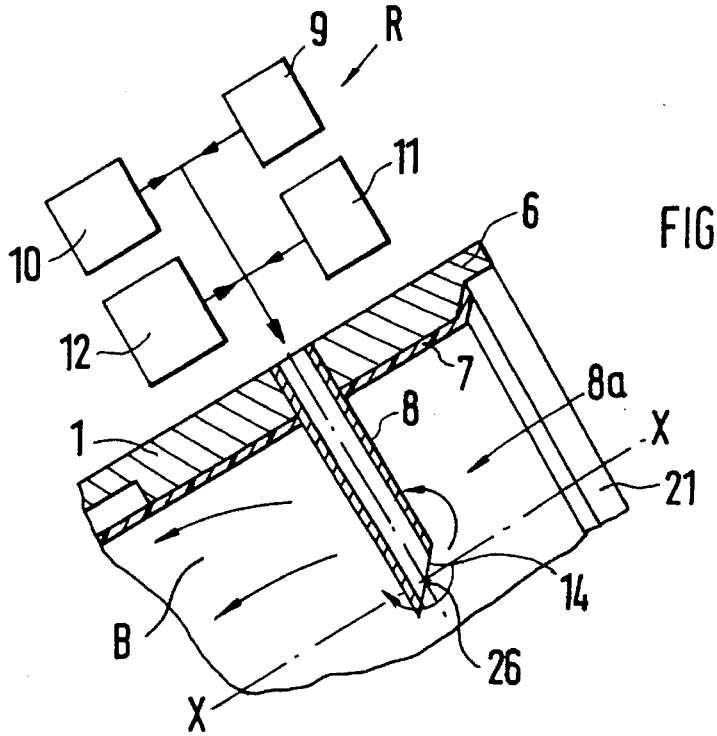
FIGS. 5 and 6 are views of the bevelled connection piece of the pollutant reducing system which projects into the intake pipe.
Figure 6:
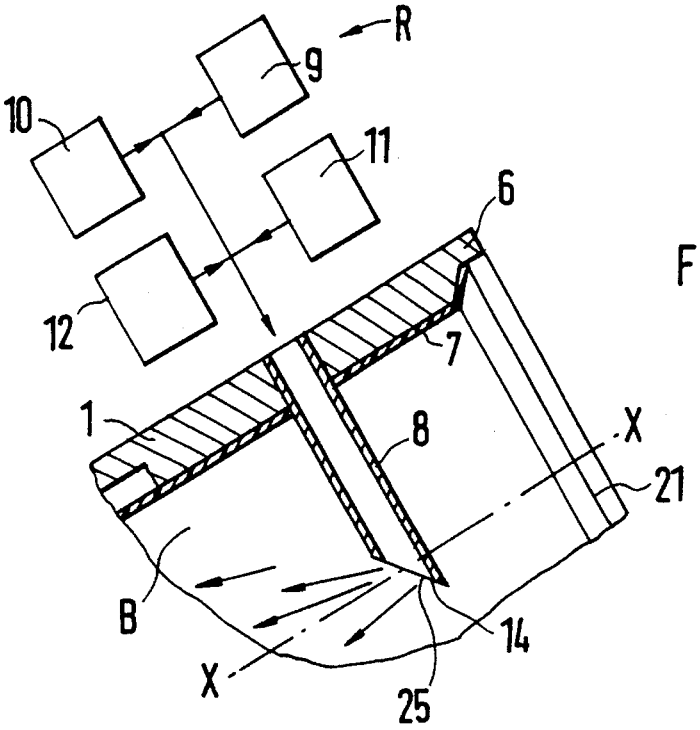

On its free end, the pipe connection 8 has a bevelling 25 or 26 so that, according to the embodiment according to FIG. 5, the oblique mouth opening 14 is directed toward the inlet opening 21 of the intake connection 6. In the case of another embodiment according to FIG. 6, the oblique mouth opening 14 faces away from the opening 21.

Figure 7:
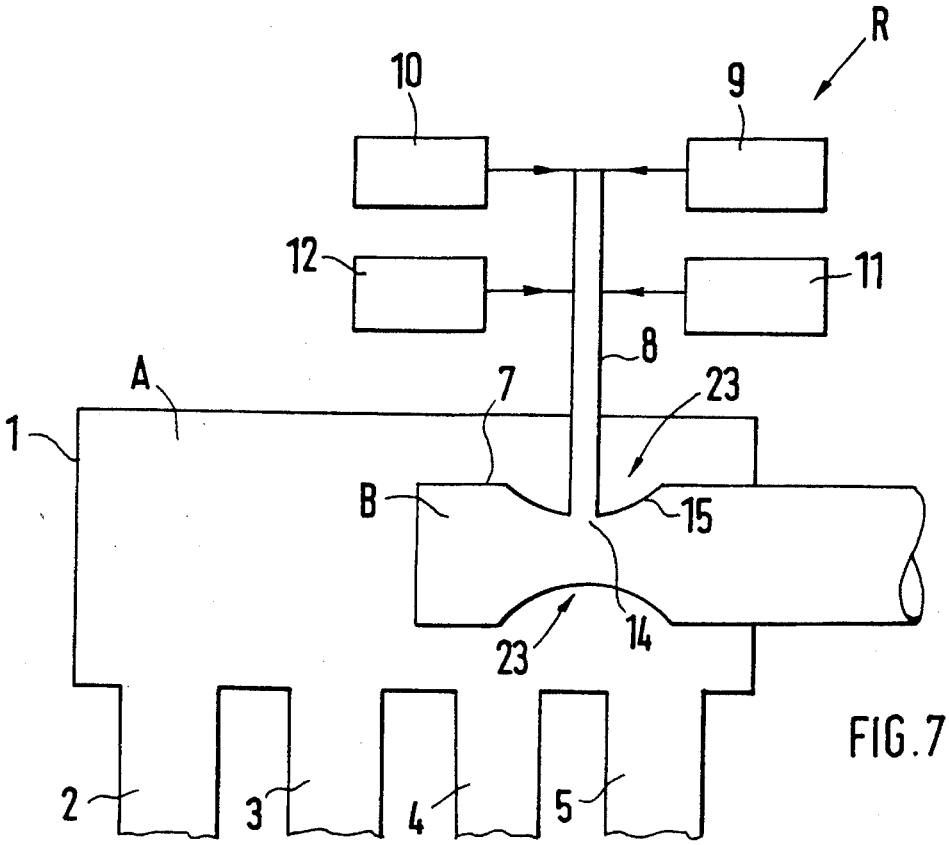
FIG. 7 is a view of a construction of the intake pipe as a diffuser with a connected connection piece.

FIG. 7 shows an embodiment of an intake pipe 7 which acts as a diffuser. For this purpose, the area of the pipe 7 into which the pipe connection 8 leads is provided with a cross-sectional contraction 23.

During the engine operation, the gases flow from the systems 9 to 12 by way of the pipe connection 8 of the pollutant reducing system R into the hollow space B of the pipe 7. In this case, the gas flow in the return system 9 and in the housing venting system 10 has a considerable temperature, whereby an intensive heat and mass exchange of the gas flow from the systems 9 to 12 takes place in the hollow space B, as well as their effective mixing. The exhaust gas, gasoline and air flow formed in the pipe connection 8, which has a high temperature, arrives in the hollow space A of the chamber 1 and flows by way of the suction pipes 2 to 5 into the individual cylinders of the engine. In this case, the above-mentioned gas flow conveys a portion of its heat to the fuel mixture arriving in the engine cylinder, whereby the vaporizability of the liquid phases of the fuel mixture is increased and the mixture becomes fine, disperse and homogeneous.

This finally leads to a more uniform distribution of the end product on the engine cylinder which consists of a fuel mixture with a gas flow from the pollutant reducing system R and leads to a better combustion of the operating filling of the mixture in the cylinders and as a result to the pollutant reduction of the engine.

By means of the oblique outlet cross-section (bevelling 25 or 26) of the mouth openings 14 of the pipe connection 8, the effectiveness of the flow mixing of the flows coming from the pollutant reducing system R, the air purification system and the air supply is increased and, as a result, the individual flows affect one another in a better fashion.

By means of the intake pipe 7 with the cross-sectional contraction 23 in the area of the entering of the pipe connection 8, in this area, the flow velocity of the air from the air purification system and air delivery system is increased and, as a result, an additional gas flow from the pollutant reducing system R is generated, and, furthermore, an additional possibility is created for controlling the volume flow rate of these gases, whereby the mixing effect of the gas flow with the gas flow from the fuel reducing system R can be increased.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Intake system for an internal combustion engine of the type having a plurality of individual cylinders, comprising:

an intake chamber, a plurality of individual suction pipes connecting the intake chamber with respective engine cylinders, an intake connection connecting an air supply system to the intake chamber, a pollutant reducing system including at least one of a housing ventilating system, an auxiliary air feeding system, a fuel vapor catch system, and an exhaust gas return system, an air intake guiding pipe connected with the intake connection and projecting into the intake chamber, said air intake guiding pipe having a mouth opening disposed in a plane between two centrally disposed ones of the suction pipes, and a pollution control pipe connection leading from the pollution reducing system into the intake chamber.

2. An intake system according to claim 1, wherein the pollution control pipe connection is arranged substantially in a plane through the center of gravity of the interior volume of the intake chamber.

3. An intake system according to claim 1, wherein said pollution control pipe connection has a substantially circular cross-section with a radius r, and wherein said pollution control pipe connection has a mouth opening into the intake chamber and with the mouth spaced a predetermined-distance from the center of gravity of the interior volume of the intake chamber.

4. An intake system according to claim 3, wherein said predetermined distance corresponds to a location on a circle with the center of gravity as the circle center and with a radius of between 0.4 r and 0.8 r.

5. An intake system according-to claim 4, wherein said circle has a radius of 0.6 r.

6. An intake system according to claim 1, wherein the pollution control pipe connection has a mouth opening substantially in the plane of the center of gravity of the interior volume of the intake chamber.

7. An intake system according to claim 1, wherein the pollution control pipe connection has a free end which projects into the interior of the air intake guiding pipe.

8. An intake system according to claim 7, wherein the pollution control pipe connection has a mouth opening arranged substantially at the longitudinal center axis of the air intake guiding pipe.

9. An intake system according to claim 8, wherein the pollution control pipe connection is bevelled at its mouth opening so as to have a mouth opening facing both radially and axially of the air intake guiding pipe.

10. An intake system according to claim 9, wherein said bevelling is involved so said mouth opening fixes axially downstream in the air intake guiding pipe.

11. An intake system according to claim 10, wherein said bevelling is involved so said mouth opening fixes axially upstream in the air intake guiding pipe.

12. An intake system according to claim 9, wherein a center of said mouth opening is disposed at a centerline of the air intake guiding pipe.

* * * * *